US006149731A

United States Patent [19]

Ko

[11] Patent Number: 6,149,731

[45] Date of Patent: Nov. 21, 2000

[54] VALVE CLEANING METHOD

[75] Inventor: Yong-kyun Ko, Kyungki-do, Rep. of Korea

[73] Assignee: Samsung Electronics Co., Ltd., Suwon, Rep. of Korea

[21] Appl. No.: 09/172,139

[22] Filed: Oct. 14, 1998

[30] Foreign Application Priority Data

Dec. 29, 1997 [KR] Rep. of Korea ..... 97-76791

[51] Int. Cl.[7] ..... C23G 1/02

[52] U.S. Cl. ..... 134/3; 134/2; 134/10; 134/22.1; 134/22.11; 134/22.12; 134/22.13; 134/22.14; 134/22.17; 134/22.18; 134/22.19; 134/26; 134/29; 134/34; 134/36; 134/41; 134/42; 134/95.1; 134/57 R; 134/169 R; 436/177; 137/240

[58] Field of Search ..... 134/2, 3, 10, 22.1, 134/22.11, 22.12, 22.13, 22.14, 22.17, 22.18, 22.19, 26, 29, 34, 36, 41, 42, 95.1, 57 R, 169 R; 436/177; 137/240

[56] References Cited

U.S. PATENT DOCUMENTS 4,552,167 11/1985 Brakelmann ..... 137/15
5,360,488 11/1994 Hieatt et al. ..... 134/22.12
5,904,173 5/1999 Ozawa ..... 137/240
5,964,230 10/1999 Voloshin et al. ..... 134/98.1
6,045,698 4/2000 Cote et al. ..... 134/29

*Primary Examiner*—Sharidan Carrillo
*Attorney, Agent, or Firm*—Jones Volentine, LLC

[57] ABSTRACT

A valve cleaning apparatus and method provide for cleaning of heat resistant, scratch resistant coated valves using deionized water and at least one chemical mixture. The cleaning method includes sampling and analysis of the chemical mixture for the presence of metal impurities to within 0.5 to 1.5 ppb. Valves cleaned using this method and apparatus can then be transferred for use in semiconductor device fabrication equipment without the danger of metal impurities from the valves entering and damaging the fabrication equipment and the semiconductor devices being fabricated. The apparatus uses a single pumping device and a single return line, which are provided with selection devices to alternatively supply to or return from the valves either the deionized water or the chemical mixture. A plurality of same-sized or different-sized valves can be cleaned simultaneously.

15 Claims, 2 Drawing Sheets

VALVE CLEANING METHOD

BACKGROUND OF THE INVENTION

1. Field of the Invention

The present invention relates to a valve cleaning apparatus and method in which impurities are removed from valves without contaminating downstream fabrication equipment. The invention may be employed for easily cleaning valves having a heat resistant, scratch resistant coating such as TEFLON (trademark of Dupont).

2. Background of the Related Art

Acid and corrosive chemicals are generally used for the wet etching and cleaning steps in semiconductor device fabrication. These steps cannot proceed properly in the presence of particles or impurities in the acid or chemicals.

The chemicals used for the wet etching and cleaning steps pass through a TEFLON valve such as a diaphragm valve mounted at one side of a liquid storage tank, before being supplied into the liquid storage tank. A TEFLON diaphragm is provided within the valve, and the valve is opened or closed using nitrogen gas ($N_2$) supplied under pressure The chemicals in the liquid storage tank are then discharged through a TEFLON valve mounted on the other side of the liquid storage tank, and are sent on to semiconductor device fabrication facilities where the wet etching and cleaning steps are performed.

When a TEFLON valve is initially mounted onto the liquid storage tank, it is cleaned by means of the chemicals from the liquid storage tank which are discharged through the valve for a predetermined period of time. However, metal impurities adhered to TEFLON parts such as the diaphragm are not completely removed by the chemicals, and may then be supplied to semiconductor device fabrication facilities, causing production problems such as inferior etching and incomplete cleaning.

SUMMARY OF THE INVENTION

Accordingly, the present invention is directed to a valve cleaning apparatus and method that substantially overcomes one or more of the limitations and disadvantages of the related art.

An object of the present invention is to provide a valve cleaning apparatus and method which easily remove impurities from the inside of a valve such as a TEFLON valve.

Additional features and advantages of the invention will be set forth in the description which follows, and in part will be apparent from the description, or may be learned by practice of the invention. The objectives and other advantages of the invention will be realized and attained by the structure as illustrated in the written description and claims, as well as the appended drawings.

To achieve these and other advantages, and in accordance with the purpose of the present invention as embodied and broadly described, a valve cleaning apparatus includes: a valve mounting unit for mounting a valve to be cleaned; a deionized water supply means for supplying, under pressure, a specified amount of deionized water from a deionized water supply source to the valve mounting unit; a chemical supply means for supplying, under pressure, a specified amount of a chemical mixture from a chemical supply source to the valve mounting unit; a deionized water discharge line for discharging the deionized water passing through the valve to be cleaned; and a chemical return line for returning the chemical mixture passing through the valve to be cleaned to the chemical supply source. The chemical supply source can supply two or more different chemical mixtures.

The deionized water supply means and chemical supply means utilize a single pumping device. Preferably, a selecting device is provided to alternatively select either the deionized water or the chemical mixture.

The plurality of same-size or different size valves to be cleaned are positioned in series or in parallel in the valve mounting unit. Valves of the same size are grouped in series, and each such group is positioned in parallel with other groups which differ in size.

The deionized water discharge line and chemical return line are constructed of a single line by means of a selecting device interposed therebetween.

In another aspect, the present invention provides a method of cleaning a valve comprising the steps of: mounting the valve to be cleaned in a valve mounting unit; selecting and supplying deionized water to the valve to be cleaned; discharging the deionized water through a discharge line; selecting and supplying a chemical mixture to the valve to be cleaned; and returning the chemical mixture to the chemical supply source through a return line, so as to circulate the chemical mixture.

A plurality of valves to be cleaned, which differ in size, are positioned in parallel lines in the valve mounting unit, and the deionized water or chemical mixture is selectively supplied to the parallel lines.

The chemical supply source comprises at least two different chemical supply sources which can be alternatively selected for supply to and return from the valve to be cleaned.

In accordance with another aspect of the present invention, there is provided a valve cleaning method comprising: (1) cleaning the valves to be cleaned with deionized water; (2) cleaning the valves to be cleaned with a first chemical mixture; (3) cleaning the valves to be cleaned a second time with deionized water; (4) cleaning the valves to be cleaned with a second chemical mixture; and (5) preparing a sample of the second chemical mixture which was used for cleaning the valves and analyzing the sample for metal impurities.

When the sample analyzed in step (5) contains an amount of a specific metal impurity below a specified standard value, the valves are further cleaned with deionized water.

When the sample analyzed in step (5) contains an amount of a specific metal impurity above a specified standard value, steps (3) through (5) are repeated.

The valves to be cleaned comprise TEFLON valves having TEFLON parts therein. The first chemical mixture comprises 25 to 35 wt. % isopropyl alcohol, 7 to 13 wt. % acetone, and residual deionized water. The second chemical mixture comprises 65 to 75 wt. % nitric acid and 28 to 34 wt. % hydrogen peroxide, which are mixed in the same ratio.

The standard value for the analysis in step (5) is preferably 0.5 to 1.5 ppb. Such an analysis can be performed using atomic absorption spectroscopy or atomic emission spectroscopy. The cleaning in each of steps (1), (2), (3) and (4) preferably progresses for more than twenty-four hours.

The metal impurities comprise iron (Fe), aluminum (Al), copper (Cu), calcium (Ca), zinc (Zn), chromium (Cr), nickel (Ni), and sodium (Na).

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings illustrate an embodiment of the invention, in which:

FIG. 1 shows the structure of a preferred embodiment of a valve cleaning apparatus according to the present invention; and FIG. 2 is a flow chart showing a preferred embodiment of a valve cleaning method according to the present invention.

DETAILED DESCRIPTION OF PREFERRED EMBODIMENT

Reference will now be made in detail to a preferred embodiment of the present invention, an example of which is illustrated in the accompanying drawings.

Figure 1:
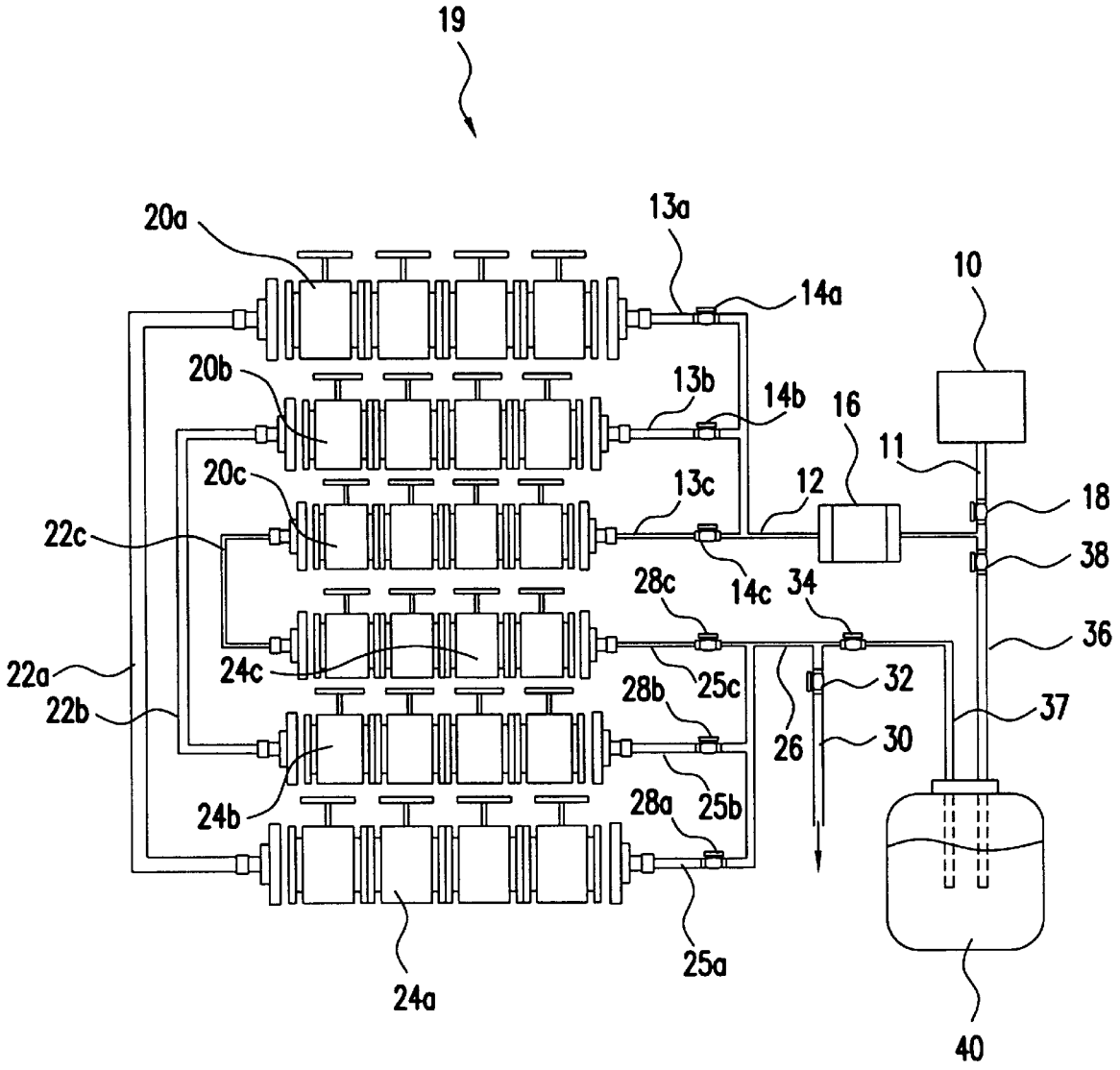

As shown in FIG. 1, a valve cleaning apparatus comprises a deionized water supply source 10 filled with a specific amount of deionized water, and an air pump 16 which operates under a supply pressure of nitrogen gas ($N_2$) to pump liquid through the apparatus. The deionized water supply source 10 is connected to one side of the air pump 16 by means of a deionized water supply line 11, on which a first interruption valve 18 is mounted.

A supply line 12 is connected to the other side of air pump 16, to connect air pump 16 to a valve mounting unit 19. The supply line 12 branches to form a plurality of divergence lines 13*a, b* and *c* whose respective ends are connected with one side of a plurality of first valve assemblies 20*a, b* and *c* mounted in parallel in the valve mounting unit 19. The first valve assembly 20*a* is constructed of a plurality of valves of the same size, connected in series with one another. The valves of first valve assembly 20*a* may be different in size from the valves of first valve assemblies 20*b* and 20*c,* and each of the valves may be a TEFLON valve such as a diaphragm valve having TEFLON parts therein. Each of the divergence lines 13*a, b* and *c* is provided with a second interruption valve 14*a, b* and *c.*

The other end of each first valve assembly 20*a, b* and *c* is connected to one of a plurality of connection lines 22*a, b* and *c,* which connect each first valve assembly 20*a, b* and *c* to one side of second valve assemblies 24*a, b* and *c* which are also mounted in parallel in valve mounting unit 19. Each of second valve assemblies 24*a, b* and *c* is constructed of a plurality of equal size valves which are connected in series with one another. The valves of second valve assembly 24*a* may differ in size from that of second valve assemblies 24*b* and 24*c,* and each of the valves may be a TEFLON valve such as a diaphragm valve with TEFLON parts.

The other side of second valve assemblies 24*a, b* and *c* are connected to a plurality of divergence lines 25*a, b* and *c* which are then joined to form a discharge line 26. Each divergence line 25*a, b* and *c* is provided with a third interruption valve 28*a, b* and *c,* respectively.

The discharge line 26 comprises a chemical return line 37 and a deionized water discharge line 30. Chemical return line 37 is connected to a chemical supply source 40. A fourth interruption valve 34 is mounted on chemical return line 37. A deionized water discharge valve 32 is mounted on deionized water discharge line 30. Deionized water discharge valve 32 and fourth interruption valve 34 form a selecting device interposed between deionized water discharge line 30 and chemical return line 37.

The chemical supply source 40 provides a specified amount of a first mixture which comprises 25 to 35 wt. %, preferably 30 wt. % isopropyl alcohol, 7 to 13 wt. %, preferably 10 wt. % acetone, and residual deionized water. The chemical supply source 40 also supplies a second mixture (not shown) comprising 65 to 75 wt. %, preferably 70 wt. % nitric acid ($HNO_3$) and 28 to 34 wt. %, preferably 31 wt. % hydrogen peroxide ($H_2O_2$), which are mixed in the same ratio.

Moreover, the chemical supply source 40 is also connected to the deionized water supply line 11 by a chemical supply line 36, which is connected to deionized water supply line 11 between first interruption valve 18 and air pump 16. A chemical valve 38 is mounted on the chemical supply line 36. Deionized water supply line 11, first interruption valve 18, chemical supply line 36 and chemical valve 38 form a selecting device by which air pump 16 and all other downstream components of the apparatus are alternatively supplied with either deionized water or a chemical mixture.

Operation of the valve cleaning apparatus described above is as follows. The specific amount of deionized water from the deionized water supply source 10 passes through the first interruption valve 18 before passing through the air pump 16. The deionized water passes through the plurality of second interruption valves 14*a, b* and *c* which are mounted on the divergence lines 13*a, b* and *c,* and then through the plurality of first valve assemblies 20*a, b* and *c.* The second interruption valves 14*a, b* and *c* are capable of being selectively opened. The deionized water passes through the second interruption valves 14*a, b* and *c* that are selectively opened, before passing through the first valve assemblies 20*a, b* and *c,* in such a way that a specific amount of particles is removed from the inside of first valve assemblies 20*a, b* and *c.*

After passing through the first valve assemblies 20*a, b* and *c,* the deionized water passes through the connection lines 22*a, b* and *c,* and then through second valve assemblies 24*a, b* and *c,* thereby removing a specific amount of particles from the inside of second valve assemblies 24*a, b* and *c.*

Subsequently, the deionized water passes through the third interruption valves 28*a, b* and *c* mounted on the divergence lines 25*a, b* and *c,* and is discharged to the outside via the deionized water discharge valve 32 located on the deionized water discharge line 30. After this, the first interruption valve 18 on the deionized water supply line 11, and deionized water discharge valve 32 on the deionized water discharge line 30 are closed, and the chemical valve 38 on the chemical supply line 36 and fourth interruption valve 34 on the chemical return line 37 are opened.

Next, as the air pump 16 performs its pumping operation, transmitting its pumping force into the first chemical mixture of supply source 40, the first chemical mixture passes through the chemical valve 38 mounted on the chemical supply line 36, before passing through the second interruption valves 14*a, b* and *c* of the divergence lines 13*a, b* and *c,* and then through the first valve assemblies 20*a, b* and *c.* Here, the second interruption valves 14*a, b* and *c* can be selectively opened. The first chemical mixture passes through the second interruption valves 14*a, b* and *c* that are selectively opened, before passing through the first valve assemblies 20*a, b* and *c.* Therefore, organic matter and particles can be removed from the inside of first valve assemblies 20*a, b* and *c.*

After passing through the connection lines 22*a, b* and *c,* the first chemical mixture passes through the second valve assemblies 24*a, b* and *c,* thereby removing the organic matter and particles from the inside of second valve assemblies 24*a, b* and *c.*

After that, the first chemical mixture passes through the third interruption valves 28*a, b* and *c* on the divergence lines 25*a, b* and *c,* before passing through discharge line 26 and the fourth interruption valve 34 on the chemical return line 37, and into the chemical supply source 40.

After this, the first interruption valve 18 on the deionized water supply line 11 and discharge valve 32 on the deionized water discharge line 30 are opened, and the chemical valve 38 on the chemical supply line 36 and fourth interruption valve 34 on the chemical return line 37 are closed.

As the pumping force of air pump 16 is transmitted to the deionized water supply source 10, a specific amount of deionized water in the deionized water supply source 10 passes through the first interruption valve 18 on the deionized water supply line 11, and then through the air pump 16.

The deionized water which passed through the air pump 16, passes through the second interruption valves 14*a, b* and *c* mounted on the divergence lines 13*a, b* and *c,* before passing through the plurality of first valve assemblies 20*a, b* and *c*. Here, the second interruption valves 14*a, b* and *c* are capable of being selectively opened. The deionized water passes through the second interruption valves 14*a, b* and *c* that are selectively opened, before passing through the first valve assemblies 20*a, b* and *c*. Therefore, the first chemical mixture is removed from the inside of first valve assemblies 20*a, b* and *c*.

After passing through the first valve assemblies 20*a, b* and *c,* the deionized water passes through the connection lines 22*a, b* and *c,* and then second valve assemblies 24*a, b* and *c,* thereby removing the first chemical mixture from the inside of second valve assemblies 24*a, b* and *c*.

Subsequently, the deionized water passes through the third interruption valves 28*a, b* and *c* located on the divergence lines 25*a, b* and *c,* and is discharged to outside by way of the deionized water discharge valve 32 on the deionized water discharge line 30.

After this, the first interruption valve 18 on the deionized water supply line 11, and deionized water discharge valve 32 on the deionized water discharge line 30 are closed, and the chemical valve 38 on the chemical supply line 36, and fourth interruption valve 34 on the chemical return line 37 are opened.

Next, as the air pump 16 performs its pumping operation, transmitting its pumping force into the second chemical mixture (not shown) of chemical supply source 40, the second chemical mixture passes through the chemical valve 38 on the chemical supply line 36, before passing through the second interruption valves 14*a, b* and *c* of divergence lines 13*a, b* and *c,* and then through the first valve assemblies 20*a, b* and *c*. Here, the second interruption valves 14*a, b* and *c* can be selectively opened. The second chemical mixture passes through the second interruption valves 14*a, b* and *c* that are selectively opened, before passing through the first valve assemblies 20*a, b* and *c,* in such a way that metal impurities can be removed from the inside of first valve assemblies 20*a, b* and *c*.

After passing through the connection lines 22*a, b* and *c,* the second chemical mixture passes through the second valve assemblies 24*a, b* and *c,* thereby removing the metal impurities from the inside of second valve assemblies 24*a, b* and *c*.

After that, the second chemical mixture passes through the third interruption valves 28*a, b* and *c* mounted on the divergence lines 25*a, b* and *c,* before passing through the fourth interruption valve 34 on the chemical return line 37, and into the chemical supply source 40.

Figure 2:
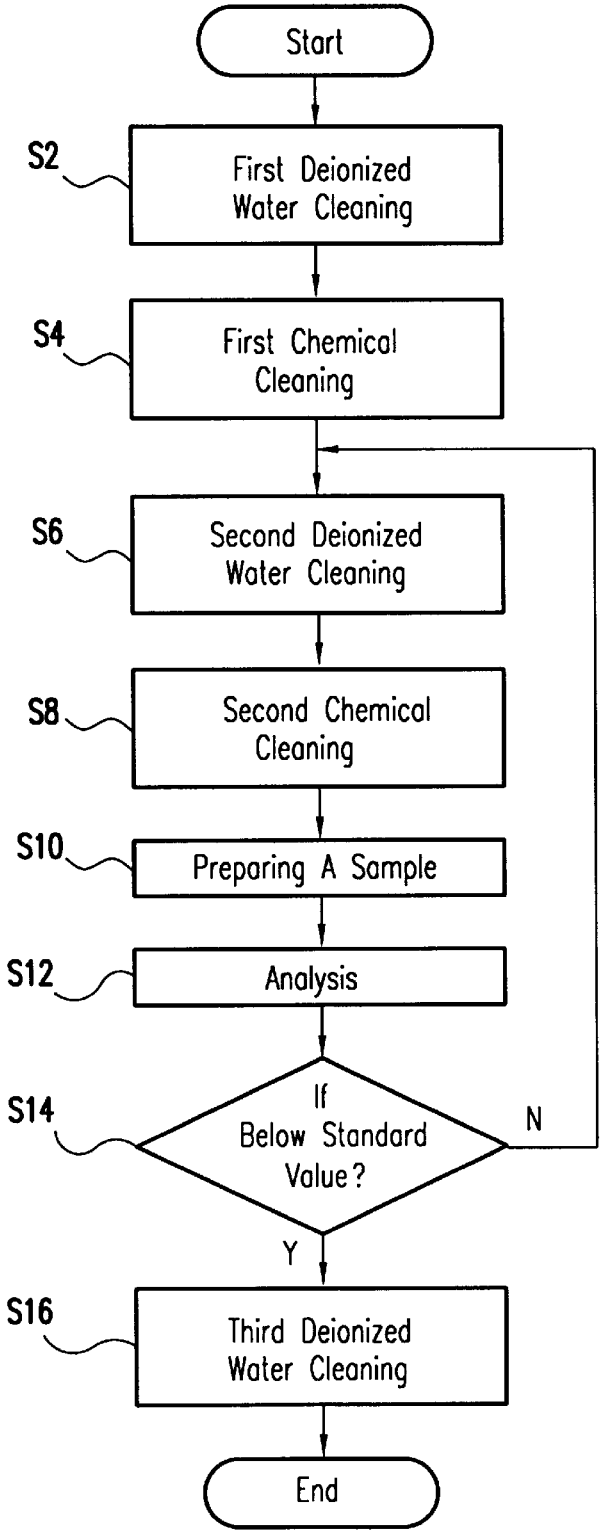

FIG. 2 shows a preferred embodiment of a valve cleaning method according to the present invention. At step S2, the valve to be cleaned, namely a TEFLON valve such as a diaphragm valve having TEFLON parts therein is first cleaned with deionized water. This first deionized water cleaning step may progress for more than twenty-four hours.

At step S4, the valve to be cleaned is cleaned with a first chemical mixture comprising 25 to 35 wt. %, preferably 30 wt. % isopropyl alcohol, 7 to 13 wt. %, preferably 10 wt. % acetone, and residual deionized water. The first chemical cleaning removes any remaining particles and organic matter from the valve, and may also progress for more than twenty-four hours.

At step S6, the valve to be cleaned is cleaned a second time with deionized water, to remove any remaining first chemical mixture therefrom. This second deionized water cleaning step may progress for more than twenty-four hours.

At step S8, the valve to be cleaned is cleaned with a second chemical mixture comprising 65 to 75 wt. %, preferably 70 wt. % nitric acid ($HNO_3$) and 28 to 34 wt. %, preferably 31 wt. % hydrogen peroxide ($H_2O_2$), which are mixed in the same ratio. During this second chemical cleaning step, metal impurities are removed from the valve. This step may progress for more than twenty-four hours.

Subsequently, step S10 is performed to prepare a sample of the second chemical mixture which has been used for cleaning the valves. At step S12, the sample is analyzed by means of atomic absorption spectroscopy or atomic emission spectroscopy, to determine the amount of metal impurities such as iron (Fe), aluminum (Al), copper (Cu), calcium (Ca), zinc (Zn), chromium (Cr), nickel (Ni), and sodium (Na), etc., which are present in the sample.

At step S14, it is determined whether the amount of metal impurities in the sample is 0.5 to 1.5 ppb, preferably 1.0 ppb or less. If the analysis finds that the metal impurity is 1.0 ppb or less, the valve to be cleaned is further cleaned with deionized water at step S16. This completes the valve cleaning steps.

If the analysis finds that the metal impurity is more than 1.0 ppb, the valve to be cleaned is returned to the second deionized water cleaning step (S6) and then the second chemical cleaning step (S8), and another sample is prepared for analysis at steps S10 and S12.

As described above, the organic matter, particles, metal impurities, etc. can be easily removed from the inside of valves such as TEFLON valves, which are mounted in semiconductor device fabrication facilities. Therefore, impurities present in the valves prior to cleaning do not enter the semiconductor device fabrication facilities.

It will be apparent to those skilled in the art that various modifications and variations can be made in a valve cleaning apparatus and method of the present invention without deviating from the spirit or scope of the invention. Thus, it is intended that the present invention cover the modifications and variations of this invention provided they come within the scope of the appended claims and their equivalents.

What is claimed is:

1. A method for cleaning a valve comprising the sequential steps of:

mounting a valve having an inner surface to be cleaned in a valve mounting unit;

selecting and supplying deionized water to the inner surface of the valve to remove particles from the inner surface of the valve;

discharging the deionized water from the valve through a discharge line;

selecting and supplying a chemical mixture from a chemical supply source to the inner surface of the valve to remove organic matter and remaining particles from the inner surface of the valve; and returning the chemical mixture to the chemical supply source through a return line;

wherein the chemical mixture comprises isopropyl alcohol, acetone, and deionized water.

2. The method according to claim 1, wherein a plurality of valves to be cleaned, which differ in size, are positioned in parallel lines in the valve mounting unit, and the deionized water or the chemical mixture is selectively supplied to the parallel lines.

3. The method according to claim 1, wherein the chemical supply source comprises at least two different chemical supply sources, one of which is selected for supplying the chemical mixture to the inner surface of the valve.

4. A valve cleaning method comprising the sequential steps of:

(1) providing a plurality of valves each having an inner surface to be cleaned;

(2) cleaning the inner surfaces of the valves a first time with deionized water to remove particles from the inner surfaces of the valves;

(3) cleaning the inner surfaces of the valves with a first chemical mixture to remove organic matter and remaining particles from the inner surfaces of the valves, wherein the first chemical mixture comprises isopropyl alcohol, acetone, and deionized water;

(4) cleaning the inner surfaces of the valves a second time with deionized water;

(5) cleaning the inner surfaces of the valves with a second chemical mixture to remove metal impurities from the inner surfaces of the valves, wherein the second chemical mixture comprises nitric acid and hydrogen peroxide; and (6) analyzing a sample of the second chemical mixture used for cleaning the inner surfaces of the valves to determine an amount of the metal impurities removed from the inner surfaces of the valves.

5. The method according to claim 4, wherein when the sample analyzed in step (6) contains an amount of a specific metal impurity equal to or below a specified standard value, the valves are further cleaned with deionized water.

6. The method according to claim 4, wherein when the sample analyzed in step (6) contains an amount of a specific metal impurity above a specified standard value, steps (4) through (6) are repeated.

7. The method according to claim 4, wherein the valves are heat resistant scratch resistant coated valves.

8. The method according to claim 4, wherein the first chemical mixture comprises 25 to 35 wt. % of the isopropyl alcohol and 7 to 13 wt. % of the acetone.

9. The method according to claim 4, wherein the second chemical mixture comprises 65 to 75 wt. % of the nitric acid and 28 to 34 wt. % of the hydrogen peroxide.

10. The method according to claim 4, wherein the sample is analyzed using atomic absorption spectroscopy.

11. The method according to claim 4, wherein the sample is analyzed using atomic emission spectroscopy.

12. The method according to claim 4, wherein steps (2), (3), (4) and (5) each progress for more than twenty-four hours.

13. The method according to claim 4, wherein the metal impurities removed from the inner surfaces of the valves comprise iron (Fe), aluminum (Al), copper (CU), calcium (Ca), zinc (Zn), chromium (CT), nickel (Ni), and sodium (Na).

14. The method according to claim 5, wherein the standard value is 0.5 to 1.5 ppb.

15. The method according to claim 6, wherein the standard value is 0.5 to 1.5 ppb.

* * * * *